US007056860B2

(12) United States Patent
Tetrault

(10) Patent No.: US 7,056,860 B2
(45) Date of Patent: Jun. 6, 2006

(54) PRINT PROTECTION, EMBEDDED PRINT PROTECTED PAGE, EMBEDDED TEXT PAGE, EMBEDDED TEXT KIT, AND METHODS RELATING THERETO

(76) Inventor: Kenneth R Tetrault, 10827 Woodland Dr., Fairfax, VA (US) 22030

( * ) Notice: Subject to any disclaimer, the term of this patent is extended or adjusted under 35 U.S.C. 154(b) by 0 days.

(21) Appl. No.: 10/141,084

(22) Filed: May 9, 2002

(65) Prior Publication Data

US 2002/0172809 A1 Nov. 21, 2002

Related U.S. Application Data

(60) Provisional application No. 60/289,516, filed on May 9, 2001.

(51) Int. Cl.
*B41M 5/20* (2006.01)
*B41M 5/24* (2006.01)

(52) U.S. Cl. ..... 503/201; 503/204; 428/13; 428/204

(58) Field of Classification Search ..... 428/13, 428/204, 195; 503/200, 201, 204
See application file for complete search history.

(56) References Cited

U.S. PATENT DOCUMENTS

| | | | | |
|---|---|---|---|---|
| 3,828,696 | A * | 8/1974 | Lockridge | 108/43 |
| 3,924,879 | A * | 12/1975 | Wright | 282/28 R |
| 4,310,978 | A * | 1/1982 | Stern | 40/600 |
| 4,499,126 | A * | 2/1985 | Suzuki et al. | 428/13 |
| 4,946,039 | A * | 8/1990 | Garran | 206/575 |
| 6,022,599 | A * | 2/2000 | Rietveld et al. | 428/14 |
| 6,148,556 | A * | 11/2000 | Seki | 40/661 |
| 6,335,799 | B1 * | 1/2002 | Provost | 358/1.4 |
| 6,338,211 | B1 * | 1/2002 | Carney | 40/124.5 |
| 6,602,334 | B1 * | 8/2003 | Kaufmann | 106/31.58 |

* cited by examiner

*Primary Examiner*—B. Shewareged
(74) *Attorney, Agent, or Firm*—Simpson & Simpson, PLLC

(57) ABSTRACT

As a writing surface, the invention provides a waterproof solid sheet that has been formed from a polyvinyl chloride and that has at least one writing face that receives controllably semi-permanent ink writing. The writing is only controllably removable from the writing face by a remover-solvent; upon removal of the writing, the writing face is left writing-free and residue-free. The writing surface otherwise resists adverse conditions.

12 Claims, 2 Drawing Sheets

PRINT PROTECTION, EMBEDDED PRINT PROTECTED PAGE, EMBEDDED TEXT PAGE, EMBEDDED TEXT KIT, AND METHODS RELATING THERETO

PRIORITY

Priority is claimed to U.S. provisional application Ser. No. 60/289,516 filed May 9, 2001.

FIELD OF THE INVENTION

The invention generally relates to recording information in semi-permanent ink, and more particularly, to writing in semi-permanent ink on plastic paper, and also to print protection (such as protection from weather, water, smudging).

BACKGROUND OF THE INVENTION

Information may be recorded in certain circumstances by manually writing on paper or other surfaces, using ink pens, pencils, chalk, or other media. Various combinations of the writing substance and the surface receiving the writing produce different degrees of permanence, and other qualities.

The applications in which information is written onto paper or another surface are varied. For example, consumers scribble shopping lists; coaches write plays; office workers note-take in meetings and students note-take in class; factory workers record production information; civilians and military personnel write-up charts and reports, etc.

The writing implements for committing information onto paper and other surfaces are varied. Lead pencils are sometimes used, and are suitable for some applications, but in many situations ink is used. Numerous inks are commercially available.

In addition to having many different conventional writing tools from which to select, many different papers and other surfaces are available from which to select, one of which is paper. Papermaking is an ancient technology, and substantial arrays of writing papers have been developed, in numerous forms. Papers of various colors, thickness, appearance, durability and size are sold. Paper is sold in single sheets, in punched forms suitable for inserting in notebooks, in glue-bound tablets, in books, in spiral-bound notebooks. Whichever paper is selected, recording information on paper is not without risk or disadvantage. For example, under certain conditions, ink on paper becomes illegible, or at least unsightly, distorted, or irregular, such as when the paper comes in accidental contact with food, beverages and various other liquids and solids. Also, paper is relatively destructible, and even in normal use for some applications may tear. Individual sheets of paper may be difficult to control, keep track of, or contain. Handled paper may look worn, dog-eared, and unprofessional.

Methods have developed, in certain applications, for writing onto non-paper surfaces, such as chalkboards, whiteboards and certain plastic sheets. The appearance and quality of the image, difficulty of use, permanence/removability, size and inconvenience of use, and the like for the conventional non-paper systems have tended to limit their use to certain particular applications.

In many applications, paper has remained the predominant writing surface. For example, the U.S. military is one context in which much or all of certain manual information recording occurs onto paper. A non-exhaustive list of examples in which military personnel record information onto paper, most often (and many applications, only) in handwritten form, includes: patrol coordination, patrol order, attack order, defense order, order annex, warning order, route card, fire plan sketch, range card, call for fire, close air support, close in fire support, communications and reporting, general information, guidelines for operation, reconnaissance sketch/report. However, in military and security applications, ink writing on paper may encounter adverse conditions.

Some writing surfaces have been developed as alternatives to paper, including certain relatively chunky products that are disadvantageously thick, an example being Poly-Dura™, manufactured by J. L. Darling Corp. Also there may be mentioned Write-in-the-rain™ paper sold by J. L. Darling Corp (Washington), which is a paper that does not degrade in water. The Write-in-the-rain™ paper is a throw-away, one-time-use product, which tends to wick, and, once wetted and allowed to dry, will not return to its original manufactured state.

SUMMARY OF THE INVENTION

It therefore is an object of this invention to provide a method of manually recording information semi-permanently, where the writing is unaffected by contact with water and most liquids and where the writing can be easily removed as desired with a certain solvent.

In a first preferred embodiment, the invention provides a writing surface, comprising: a waterproof solid sheet that has been formed from a polyvinyl chloride and that has at least one writing face that receives controllably semi-permanent ink writing, the writing being only controllably removable from the writing face by a remover-solvent, further providing that the writing face is left writing-free and residue-free upon such removal.

In another preferred embodiment, the invention provides a method for protecting print, comprising: (A) providing an opaque plastic layer and having a top surface and/or a bottom surface on which may be received print; (B) printing on one or both surfaces of the opaque plastic layer; (C) sandwiching the printed opaque plastic layer between a first clear layer and a second clear layer, and applying temperature and pressure conditions whereby a single solid piece of polyvinyl is formed.

Additionally, in another preferred embodiment, the invention provides a method for producing a reusable plastic paper in which is disposed a printed template, comprising: (A) providing an opaque plastic layer and having a top surface and/or a bottom surface on which may be received print; (B) printing on one or both surfaces of the opaque plastic layer; (C) sandwiching the printed opaque plastic layer between a first clear layer and a second clear layer, and applying temperature and pressure conditions whereby a single solid piece of polyvinyl is formed.

Additionally, the invention in another preferred embodiment provides a writing surface, comprising: a waterproof solid sheet that has been formed from a polyvinyl chloride and that has at least one writing face that receives controllably semi-permanent ink writing, the writing being controllably removable, further providing that the writing face is left writing-free and residue-free upon such removal.

The invention in another preferred embodiment provides a kit comprising: a solid writing surface, the writing surface receiving controllably semi-permanent writing, the writing not removable by water, the writing further being removable by a remover-solvent without leaving a residue on the solid writing surface; and a writing implement imparting onto the solid writing surface writing (i) not removable by water, and (ii) removable by a remover-solvent without leaving a residue on the solid writing surface. Optionally, but preferably, the kit may: further include a remover-solvent that removes the writing imparted onto the solid writing surface, without leaving a residue on the solid writing surface. The kit preferably may include a writing surface (such as, e.g., a solid writing surface that upon perforation retains waterproof and weatherproof characteristics; a solid writing surface including a sheet having a pre-printed underlying written section (such as a template, a checklist, a text, etc.); etc.) and an ink-pen for writing thereon. Preferably the solid writing surface is a substrate or surface not susceptible to separation.

Further perfecting details may be mentioned about the inventive writing surfaces, methods, systems, kits, products, etc., without the invention being limited to such details.

The writing surface mentioned above may be clear; and/or may have written information (such as, e.g., a map, etc.) underlying the solid surface, the written information consisting of ink around which has formed a unitary block, the writing surface being a top face of the unitary block and the ink being embedded in the unitary block; etc.

Where a clear writing surface is provided, there may be further included a guide-mark coordinating to at least one printed or written material separate from, but useable with, the clear writing surface.

Where a writing surface is provided, in a particularly preferred embodiment, the writing surface has been written-on with controllably semi-permanent ink, the ink being known to be removable with a certain particular remover-solvent, and the written-on writing surface being waterproof. Most preferably, when a written-on writing surface is provided, the written-on writing surface resists accidental smudging; and/or upon perforation is only damaged where perforated. In a preferred example, the writing surface has been written-on with controllably semi-permanent ink for at least a first writing to provide a written-on surface, and the written-on surface has been fully removed of ink at least a first erasure, ink removal having been by a pre-selected remover-solvent matching the controllably semi-permanent ink. In another preferred example, the writing surface has been subjected to a plurality of cycles of writing/erasure, with the writing surface being ink- and residue-free.

Above where an a opaque plastic layer has been mentioned, preferably there is provided such a layer of a thickness of about 0.010" (10 mil). For the above-mentioned single solid piece of polyvinyl formed, preferably the single formed piece is of a thickness of about 0.014" (14 mils).

Where writing is provided, the writing is especially preferred to be controllably removable by strenuous application of finger pressure and/or by application of a remover-solvent.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
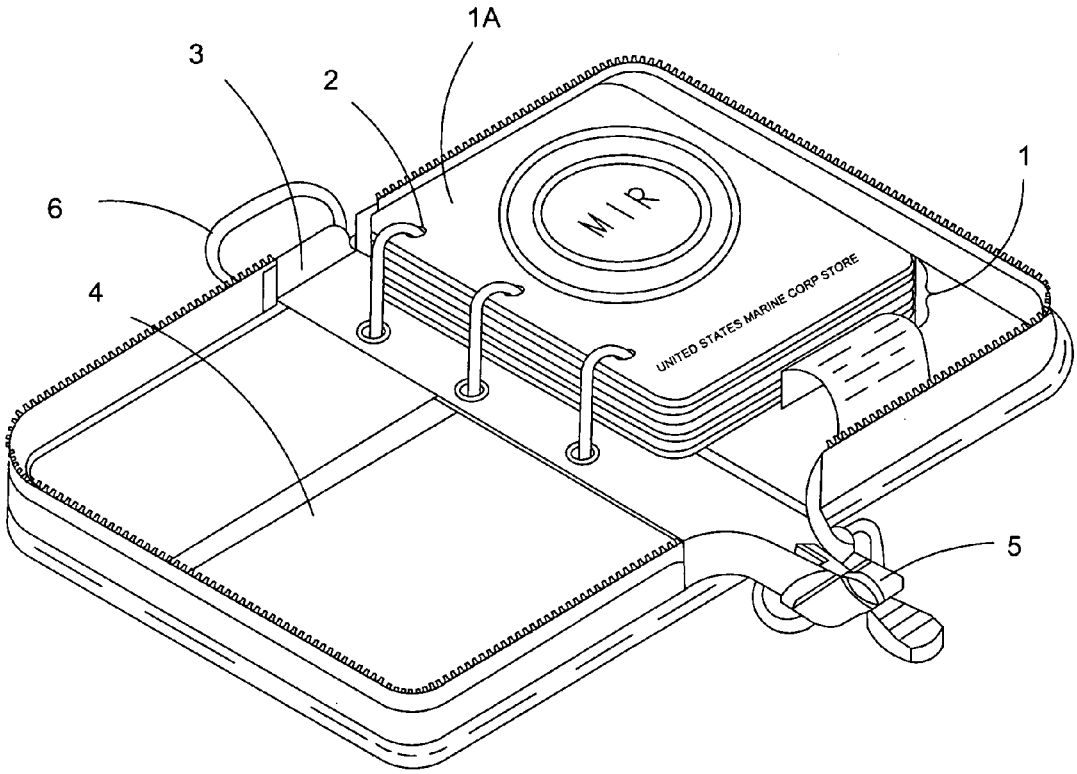
FIG. 1 is a perspective view of an exemplary zippered kit according to the invention, including plastic pages suitable for being written-on in ink.

In a first preferred embodiment, the invention provides a writing surface (such as a page) and an ink-pen for writing thereon, such that the writing is semi-permanent, the semi-permanence being controllable. The semi-permanent writing is not removed by water, or by most liquids. The writing is easily removable by a remover-solvent according to the invention, and the solvent removes the ink without leaving a residue on the writing surface.

Most preferably, as to weight, the writing surface/paper replacement/plastic page resembles a sheet of paper as to light weightness. The writing surface may be in a range of flexibilities, such as from being flexible or relatively-flexible like some papers to relatively rigid or rigid.

In a preferred embodiment, the writing surface and ink pen are provided in a kit. The remover-solvent optionally is provided in the kit. A suitable combination of ink, remover-solvent and writing surface may be used, such that the ink withstands water and most liquids, is not susceptible of being smudged-off and is easily removable as desired by the remover-solvent without leaving a residue. In a most preferred embodiment, the ink, remover-solvent and writing surface are a combination in which the ink withstands water and all liquids except the remover-solvent, with the remover-solvent easily removing the ink without leaving a residue on the writing surface.

In a preferred embodiment, the writing surface is one that is only marginally affected by perforation, in that the writing surface retains all of its physical characteristics (waterproof- and weatherproof-ness), the user only being affected if the damage to the writing surface occurs in an area that disrupts the functionality of the template, checklist or text, if any. This feature is unlike a conventional laminated paper which when perforated and exposed to water allows the paper to become saturated causing catastrophic failure of the page.

The writing surface preferably used in the invention will not separate, unlike laminate on laminate bonds that separate over a relatively short period of time. The writing surface may be a single sheet of plastic, not susceptible to separation. Surfaces (such as many laminated surfaces) that are susceptible to separation are not suitable for use in the present invention.

A page preferably used in the invention may be constructed using a substrate or core material that is impervious to water and weather. Thus, perforation of the product page does not cause product failure.

In the present invention, a page may be made by applying a plastic sheet to the substrate under conditions of temperature and pressure to form a single plastic page/sheet/writing surface. More preferably, a page may be made by sandwiching a substrate between two respective plastic sheets under conditions of temperature and pressure to form a single plastic page/sheet/writing surface. The plastic page used in the present invention may be made from multiple pieces of plastic processed under heat and pressure to form a single piece of plastic with or without embedded text.

In making the page, a base page with text, such as artwork, may be provided. The digital artwork for such a base page may be created in high-resolution postscript format, such as by using QuarkXpress software, and may be electronically digitally imaged on litho negatives for transfer to printing plates. Any suitable lithographic materials including polyvinyl chloride (pvc) sheets, plates, inks, blankets, packings, etc. may be used for high density printing on co-polymer vinyl sheets, i.e., the material used for plastic credit cards and security ID cards. Pvc sheets and related materials used may be those with a relatively long drying time compared to paper.

As a base substrate for making a page according to the invention, preferably a base substrate vinyl is used, such as a rigid polyvinyl chloride, most preferably a rigid pvc manufactured by Klockner Pentaplast of America, Inc. (Gordonsville, Va.) such as Pentapharm, Pentafood, Pentaclear, Pentadur, Pentamed, Pentaform, Pentaprint, Pentatherm, Pentalan, Pentastat, Pentacard and Pentasound.

In cases where printing is done, after printing, the PVC sheets may be over-laminated in a hydraulic lamination press using thin clear UV inhibiting film covering the front and back of each sheet. The printing and covering method provides a clear film that protects the printed surface from scratches, scuffing, dirt and fading due to exposure to sunlight. Particularly preferable examples of a material used for overlaminating according to the invention is a pvc film selected from the group consisting of BVDC, BVRC, BPVC, BBBC, BBFC and BPG films of Nan Ya Plastics Corp. (Wharton, Tex.). There thus may be provided a vinyl sheet, and/or a high polish or matte surface that permits wiping of dirt, smudges and fingerprints. Where a large sheet (such as a sheet having 16 formats) is used, after formation of a single plastic writing surface sheets, the sheets may be die cut into smaller sized sheets, such as sheets sized for a certain notebook.

Figure 2:
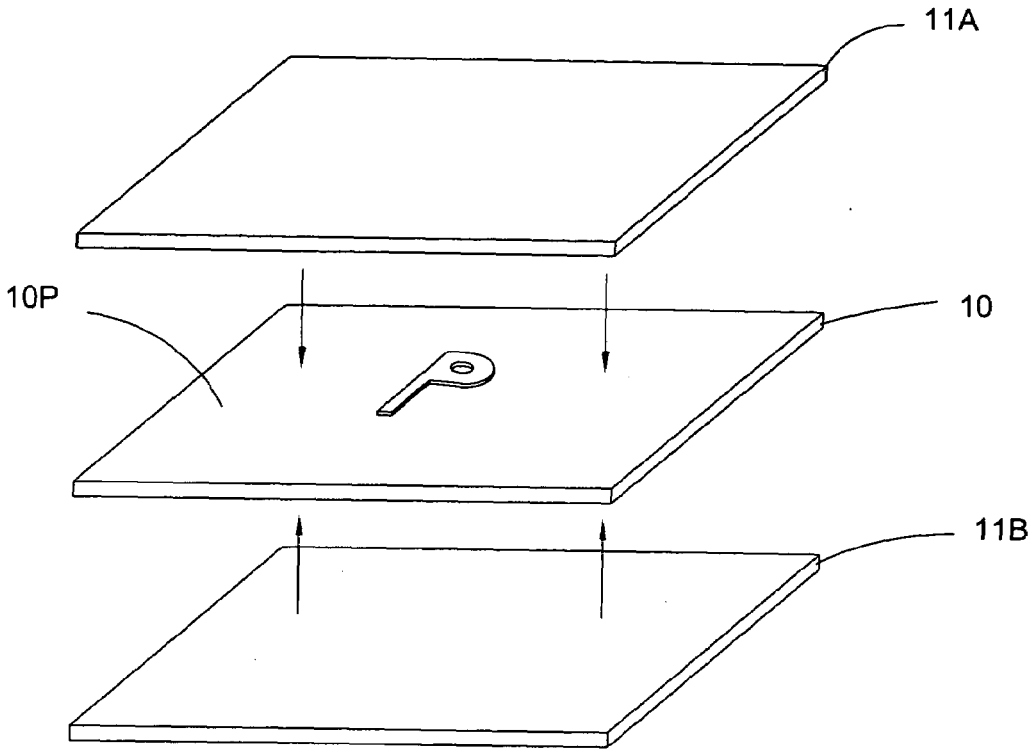
FIG. 2 is an exploded perspective view of construction of an exemplary plastic paper according to the invention, in which a template has been printed, before application of temperature and pressure conditions to form the plastic paper.
Figure 3:
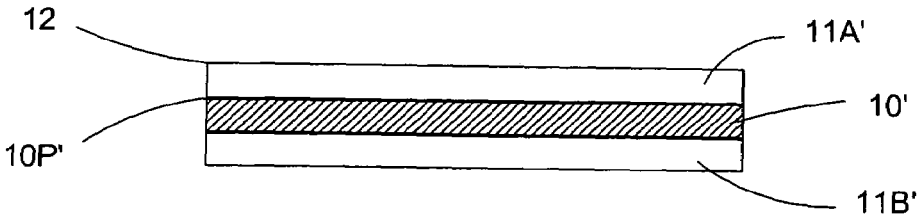
FIG. 3 is a cross-sectional view of an exemplary plastic paper according to the invention, in which a printed template underlies the writing surface.

An exemplary method of producing a plastic paper in which printing is contained may be seen with references to FIGS. 2 and 3. As shown in FIG. 2, an opaque plastic layer 10 was provided, and, in this case, printing P was printed onto a surface of the opaque plastic layer 10, the printed surface 10*p* being shown as the top surface. Next there are provided two clear layers 11A, 11B, between which the printed opaque plastic layer 10 is sandwiched. In FIG. 2, the components 10, 11A, 11B are shown before application of temperature and pressure conditions for forming a single solid piece of polyvinyl. Temperature and pressure conditions are applied to form a single solid piece of polyvinyl 12 as shown in FIG. 3. In the single solid piece 12, layers 10, 11A, 11B have been chemically and/or physically modified somewhat to permanently join or bond with the adjoining layer, the bonded layers 10', 11A', 11B' being shown on FIG. 3. The printed surface 10*p* of FIG. 2 has been formed into the protected printed surface 10*p*' in FIG. 3.

Following a sandwiching procedure according to the invention, such as the sandwiching procedure of FIGS. 2 and 3, advantageously protects print by embedding the print. This may be contrasted with a situation, not according to the invention, where printing is performed on top of a plastic material; a remover solvent usually would such unprotected template printing along with the writing desired to be removed, so that the template printing desired to be left could not be assured of remaining. The present invention recognizes and addresses this problem of protecting template print, and provides for protected template print in a reusable writing surface, where the writing surface may be solid or clear (and, when clear, optionally may be overlaid and/or used with other writing sheets, maps, etc.). The protection afforded the embedded print by the present invention is protection from undesirable physical, chemical, and/or environmental effects, including, but not limited to, finger oil and pressure (deterioration from physical handling; i.e.—plastic with surface print which is removed through the friction of handling), wear, weather, etc. The protection afforded the printing by the protective methods of the present invention is superior to laminated paper (where damage spreads), because damage to a protected-print product according to the present invention is relatively confined, with the user only being affected if the damage occurs in the printed area. This feature is unlike a conventional laminated paper which when perforated and exposed to water allows the paper to become saturated causing catastrophic failure of the page.

It will be appreciated that where no printing (such as a printed template) is desired in the plastic paper, the above-mentioned production processes for making a print-protected sheet generally may be followed, except for omitting the printing step, such as a production process of forming a plastic layer/opaque layer/plastic layer sandwich, etc.

For the above-mentioned opaque layer starting material, preferably the thinnest available opaque material is used, such as the opaque materials by Klockner that are commercially available. Likewise, with the above-mentioned plastic layers to be used for sandwiching the opaque layer, preferably thin layers are used.

In a preferred embodiment, a suitable ink/remover-solvent combination for using in the present invention is the ink sold by Staedtler Lumocolor as its permanent ink of the felt tip type (product no. 313 UPC 313-9, no. 0 31901 90857 7), with a remover-solvent selected from the group consisting of the solvent sold by Staedtler Lumocolor-Ex (correction pen product no. 319 EAN, 40 07817 30457 0; Lumocolor ink remover) and the solvent sold by Sanford Expo (spray bottle; white board cleaner). The ink to be used in the present invention preferably is provided in the form of a hand-held writing implement with a relatively-soft ink-delivering tip, such as a felt tip pen or marker.

Inks that leave permanent marker residue in the writing surface (e.g., Sanford Expo (dry erase marker); Sanford Vis-à-vis; Sanford Sharpie) are not suitable for use in the present invention. Inks that can be easily removed in the manner of white board inks, such as with cloth, by hand, or by pages rubbing together or the like (e.g., Boone (dry erase marker)), are not suitable for use in the present invention. Ball point or other hard tipped pens that leave a permanent impression in the surface like paper, ruining the page, effectively creating a one time writing surface, are not desirable for use in the present invention.

The remover-solvent to be used in the present invention may be provided in various forms, such as a spray (such as the Sanford spray solvent mentioned above), a solid (such as in the form of an eraser-pen (such as the Staedtler eraser-pen mentioned above)), a solvent-moistened cloth, etc. Most preferably, the remover-solvent is provided in pen form, such as a separate pen from the ink pen or as the other end of the ink pen used in the invention.

The ink pen and/or the remover-solvent (or, the combination ink pen/remover-solvent pen) may be fastened (such as by a cord) to the writing surface. It will be appreciated that the ink pen (and, in the case of a pen of remover-solvent) may be capped for protecting the pen tip, and, further, there may be provided optional additional casing or housing for protecting any pen tip when not in use.

Moreover, while the invention has been described in terms of a preferred convenient-to-use embodiment in which a remover-solvent/ink pen pair is used, it will be appreciated that in other embodiments of the invention, a remover solvent may not necessarily be required. For example, when using the Staedtler 313 ink pen on a plastic paper according to the invention, the ink writing may be rubbed-out by strenuous application of finger tip pressure, providing additional security by permitting erasure of the writing in an emergency in which the corresponding solvent may be unavailable.

The writing surface/paper replacement/plastic page, with or without writing, according to the present invention in relation to its environment is weatherproof (rain, snow, wind, other weather), waterproof, relatively durable (i.e., more resistant than paper to a harsh environment, such as dirt, sand, grit, general abuse, etc.). The writing surface/paper replacement/plastic page according to the present invention may function better in or under water than paper, and offer better performance at a wider temperature range than paper. The writing surface/paper replacement/plastic page may be clear, matte and colored, etc. Most preferably, the finish on a writing surface is matte, such as a matte finish on a clear sheet.

In the case of a clear writing surface, the clear writing surface may be placed on top of written or printed information (such as a template, a map, etc.), the clear writing surface being removable from the written or printed information. When a clear writing surface is used, preferably a guide-mark is included on or in the clear writing surface, such as a guide-mark for aligning or properly coordinating the clear writing surface with underlying written or printed information with which the clear surface is used. A clear writing surface with such a guide-mark can be used for providing improved confidentiality, such as by permitting writing on the clear writing surface to be more stand-alone than if the under-sheet information (such as a map, etc.) was required to be included on the same writing surface. Additionally, there are many practical applications in which a template on a clear sheet may be useful. A clear overlay according to the invention that is separable from a related material (such as a map) may be provided.

The writing surface/paper replacement/plastic pages according to the present invention are designed for the express purpose of re-use. The invention thus provides a significant advantage over paper and pen, in which case the paper can be used only once, and must also be disposed of, creating a logistic disadvantage.

The invention in a preferred embodiment provides a kit of relatively small size and lightweight. The writing surface/paper replacement/plastic page of the present invention may be configured in any physical size. In FIG. 1 showing an embodiment of the invention, a plurality of exemplary writing surfaces 1 are shown, with the top face of writing surface 1A visible. While writing surface 1A has underneath the writing surface printed text, it will be appreciated that a writing surface according to the invention is not required to have underlying text.

In FIG. 1, writing surfaces 1 are shown having punched therein holes 2 for disposing the writing surfaces 1 in a ringed notebook 3. An advantageous but optional feature of the particular ringed notebook 3 shown in FIG. 1 is the at least one pocket 4 for receiving an ink pen that writes on the writing surfaces 1 in a controllably removable, semi-permanent manner. Another advantageous but optional feature of the ringed notebook 3 shown in FIG. 1 is the zippered closure 5, for containing accessories (such as a writing implement, a remover-solvent, etc.) for use with the writing surfaces 1. Another advantageous optional feature is the at least one carrying tab 6, for connecting the ringed notebook to a user's other gear. It will be appreciated that other tab(s), hook(s) and/or fastener(s) may be provided in connection with a writing surface according to the invention (such as writing surfaces 1A, 1).

For a writing surface according to the invention, the substrate may be of various colors or clear, may have printed thereon copy customized to suit customer specifications, or be blank. Where text is provided, the text may provide the user with information that is pertinent to the specific task which the product has been designed to help accomplish; i.e., information on the correct order of, and steps to take when tasked with completing: an operations order or a call for fire work sheet (template or text supporting template use) or the priority of work in the defense (checklist) or important information provided as bulleted reminders for executing operations in cold weather or the schematics to a five ton truck engine used for field repair (stand alone text information for use without a template).

In a preferred embodiment of the present invention, templates may be used as text imbedded in the writing surface. Templates are areas of lined space on the product pages specifically designed for recording information, removal of the information, then recording of information, removal, etc. A template can be simple (such as a group of lined pages designed for the recording of miscellaneous notes or a patrol log), or specific and sophisticated (such as a patrol order, close air support request or reconnaissance observation report sheet). Using templates according to the present invention advantageously provides a consistent framework for addressing specific tasks, procedures and reports; facilitates force-wide adherence to standard operating procedures and intelligence gathering and reporting; reduces planning cycle time (a fill-in-the-blank or template format provides ease of use and insures standardized, complete and accurate planning and reporting; acts as a "rehearsal" trainer, creating greater proficiency with each successive use); provides a specific mechanism to disseminate counter-intelligence (makes possible insertion of false planning details, including locations, units, routes, etc., into the standardized templates along with maps, patrol journal entries, etc.).

The present invention may be used, by way of non-limiting example, in military applications including Infantry (Patrol coordination; Patrol order; Patrol overlay; Attack order; Defense order; Order annex(s); Warning order; Route card; Fire plan sketch; Range card; Call for fire; Close air support; Close in fire support; Communications and reporting templates; General information/guidelines for operations, etc.); Reconnaissance/Intelligence (Patrol coordination; Patrol order; Patrol overlay; Order annex(s); Warning order; Route card; Fire plan sketch; Range card; Call for fire; Close air support; Close in fire support; Communications and reporting; Beach survey report; Bridge report; Contact report; River/ford report; Surf observation report; General information/guidelines for operations, etc.), Operational Communications, Armor, Artillery, Combat Engineer (Enemy stores and equipment report, Water point report, Airstrip report, Bridge site report, Obstacle report, Executed demolitions report, etc.), Logistics, Maintenance, Motor Transport, etc.

The applications of the present invention include the military (e.g., Armed forces of the United States: Army, Navy, Air Force, Marines, or other armed forces) and civilian use, such as search and rescue applications, police applications, mountaineering/hiking or kayaking applications, first aid manual, a football coach's playbook, journals, date-books, calendars, telephone/address books, self-testing and other educational/teaching materials, drink/food order cards (such as for use on airlines, at restaurants, etc., especially where an embedded template may be used to match a seating plan), etc., as non-limiting examples.

The invention is particularly well-suited for the creation of copy or related writing surface pages which are coordinating but not necessarily identical. For example, writing surface pages that initially are coordinating (such as being identical, placeable on the same master underlying template, etc.) may be, e.g., (1) marked on by a marking author, with the marking author creating different marked-up sheets, followed by distribution of the marked-up sheets to respective different users; or (2) distributed to different users, who respectively mark the sheets, and return the marked sheets to someone who overlays the respective marked sheets. The invention provides the advantage that copies or variant sheets from different sources can be overlaid. Thus, the invention may be used for providing information in a manner that is advantageous for strongly and precisely communicating information from different sources, while lessening the time needed to synthesize the various sources and/or lessening the need to re-write or re-enter the information to achieve the same information effect.

Additionally, the invention also permits for information-gathering and information-display to be relatively secure, as may be desired in particular applications. Security can be further enhanced by including a self-destruction feature in a writing surface according to the invention, such as a component (such as a magnesium component) for igniting and burning the paper as desired.

A further advantage of the present invention may be seen in the reduction of use of traditional paper.

The following Examples show various aspects and embodiments of the invention.

EXAMPLE 1

A starter kit is provided with blank-lined pages of writing surface, an ink pen and a solvent pen according to the invention. The user selects which provided blank-lined pages to use, such as which pages to include in a notebook in which the pages may be removably inserted. FIG. 1 shows one example of such a starter kit according to the invention.

EXAMPLE 2A

An opaque layer (Klockner) was printed, then sandwiched between two plastic layers (pvc) at conditions of high temperature and high pressure. A plastic paper according to the invention was formed, having a thickness of about 0.014" (14 mils).

EXAMPLE 2B

An unprinted opaque layer (Klockner) was sandwiched between two plastic layers (pvc) at conditions of high temperature and high pressure. A plastic paper according to the invention was formed, having a thickness of about 0.014" (14 mils).

EXAMPLE 3

A plastic paper of Example 2B (the present invention) was written-on using Staedtler Lumocolor permanent ink pen 313. A few seconds after writing, the ink resisted smudging upon light and moderate application of a fingertip, and only erased with strenuous finger-rubbing. Upon application of a Staedtler Lumocolor-EX 313 remover pen to the writing, the writing was rendered entirely illegible. By applying a fabric to the illegible area with a light brush, the plastic paper was restored to its original state before the writing, writing-free, residue-free and without permanent marking observable by the human eye.

While the invention has been described in terms of its preferred embodiments, those skilled in the art will recognize that the invention can be practiced with modification.

I claim:

1. A writing kit, comprising:

(1) a re-usable writing surface, consisting essentially of: a waterproof solid sheet of thickness about 14 mils (0.014 inches) that has been formed from a polyvinyl chloride and that has at least one writing face that receives a waterproof, controllably semi-permanent ink writing removable from the writing face by a pre-selected remover-solvent (2) a controllably semi-permanent ink for writing the waterproof, controllably semi-permanent ink writing on the surface, and (3) the remover-solvent; wherein the remover-solvent fully removes the waterproof, controllably semi-permanent ink writing, leaving the writing face writing-free and residue-free.

2. The writing kit of claim 1, wherein the writing surface is clear.

3. The writing kit of claim 1, wherein written information underlies the solid surface, the written information consisting of ink around which has formed a unitary block, the writing surface being a top face of the unitary block and the ink being embedded in the unitary block.

4. The writing kit of claim 3, wherein the written information is a map.

5. The writing kit of claim 2, including a guide-mark coordinating to at least one printed or written material separate from, but useable with, the clear writing surface.

6. The writing kit of claim 1, wherein the writing on the writing surface resists accidental smudging.

7. The writing kit of claim 1, wherein the writing surface upon perforation is only damaged where perforated.

8. The writing kit of claim 1, wherein the writing surface after a plurality of cycles of writing/erasure is ink- and residue-free.

9. The kit of claim 1, wherein the ink is contained in a hand-held writing implement with a relatively-soft ink-delivering tip.

10. The kit of claim 1, wherein the remover-solvent is in pen form.

11. The kit of claim 1, wherein the ink is contained in a hand-held writing implement with a relatively-soft ink-delivering tip and the remover-solvent is in pen form.

12. The kit of claim 1, wherein the used writing surface is restorable by light brush with a fabric to its original pre-writing state without permanent marking observable by human eye.

* * * * *